United States Patent [19]

Rohde et al.

[11] Patent Number: 4,899,911

[45] Date of Patent: Feb. 13, 1990

[54] APPARATUS AND METHOD FOR DISPENSING AN INDIVIDUAL BEVERAGE SERVING

[75] Inventors: William A. Rohde, Lake Bluff; Joseph J. Pletka, Downers Grove; Brian R. Hochstatter, Sterling; Olaf Kivioja, Villa Park, all of Ill.; Thomas Otto, Gower, Mo.

[73] Assignee: Multimix Systems, Inc., Oak Brook, Ill.

[21] Appl. No.: 227,243

[22] Filed: Aug. 2, 1988

[51] Int. Cl.[4] ..... B65D 35/28

[52] U.S. Cl. ..... 222/103; 222/92; 222/107; 222/129.1; 239/432

[58] Field of Search ..... 222/92, 94, 95, 107, 222/103, 105, 129.1, 129.3, 129.4; 206/632, 67, 107; 239/432, 433; 366/337, 338, 341

[56] References Cited

U.S. PATENT DOCUMENTS

| | | | |
|---|---|---|---|
| 2,630,183 | 3/1953 | Foutz | 239/432 |
| 3,189,227 | 12/1962 | Hobbs . | |
| 3,418,059 | 3/1967 | Robe . | |
| 3,469,521 | 3/1966 | Simjian . | |
| 3,659,512 | 5/1972 | Dietz et al. | 222/103 |
| 3,884,228 | 5/1975 | Hahn . | |
| 3,913,789 | 10/1975 | Miller | 222/107 |
| 4,054,232 | 10/1977 | Cawley | 222/107 |
| 4,163,510 | 8/1977 | Strenger . | |
| 4,168,018 | 3/1976 | Zahaykevich . | |
| 4,220,259 | 12/1978 | Lagneaux . | |
| 4,270,673 | 6/1981 | Rodth | 222/129.3 |
| 4,520,948 | 6/1985 | Hampel et al. | 222/105 |
| 4,708,266 | 11/1987 | Rudick | 222/132 |
| 4,759,472 | 2/1987 | Strenger . | |
| 4,808,346 | 2/1989 | Strenger | 222/95 |

FOREIGN PATENT DOCUMENTS

| | | | |
|---|---|---|---|
| 0179641 | 10/1985 | European Pat. Off. . | |
| 933085 | 7/1964 | France . | |
| 2122881 | 5/1983 | United Kingdom . | |
| 8802339 | 4/1988 | World Int. Prop. O. | 222/94 |

*Primary Examiner*—Joseph J. Rolla
*Assistant Examiner*—Steve Rein
*Attorney, Agent, or Firm*—Niro, Scavone, Haller & Niro, Ltd.

[57] ABSTRACT

An apparatus and method for dispensing an individual beverage serving are disclosed wherein a rupturable packet containing a flavoring constituent is ruptured by a mechanically actuated platen. Platen movement during the dispensing cycle is controlled by a specially configured cam and dependent upon predetermined volumes of flavoring constituent and gas within the packet. A nozzle assembly is employed for mixing the flavoring constituent with a base liquid and includes a deflector for insuring substantially uniform mixing and elimination of undesired foaming in the beverage. A specially configured rupturable packet is employed in which the side seals and the seal forming the packet spout are stronger than the peel seal of the packet, but weaker than the top closure seal. Another packet design employed with the apparatus has a spout which is angled to one side.

24 Claims, 10 Drawing Sheets

FIG. 1
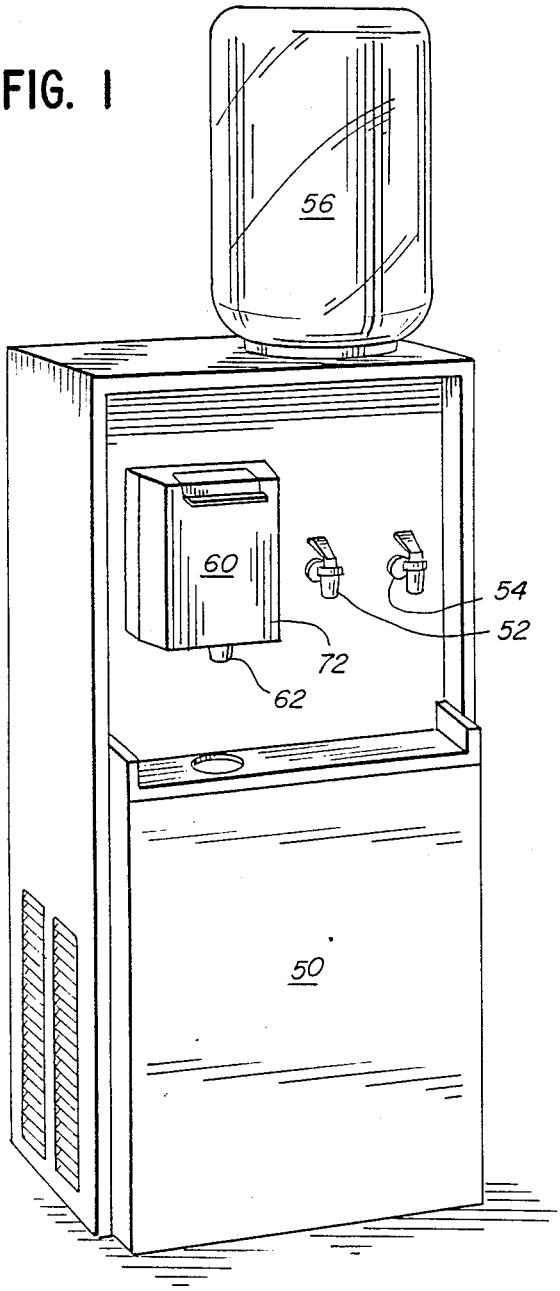
FIG. 2
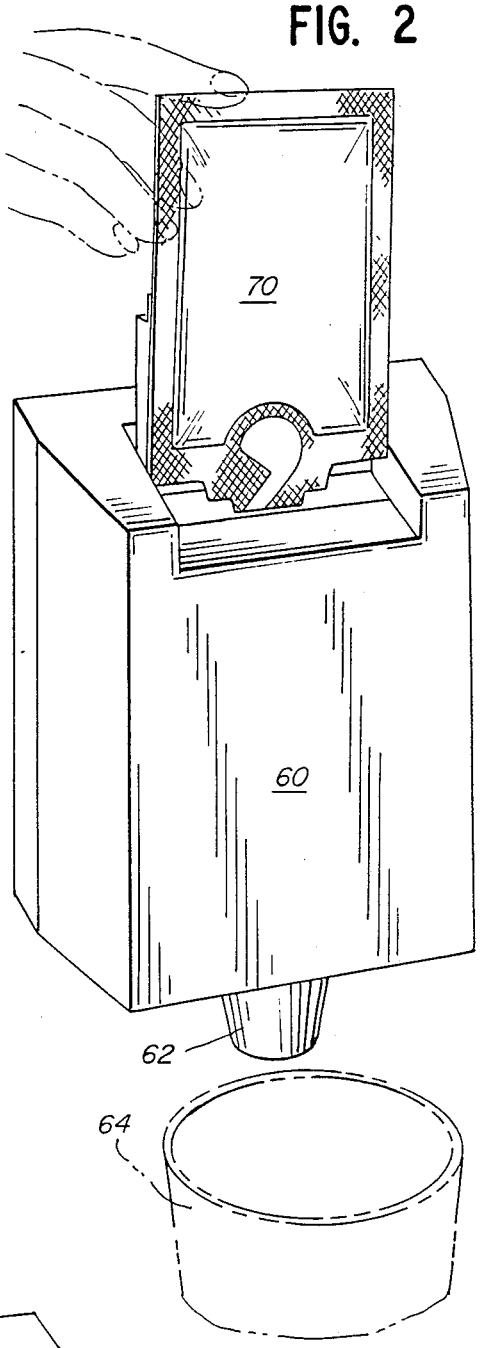
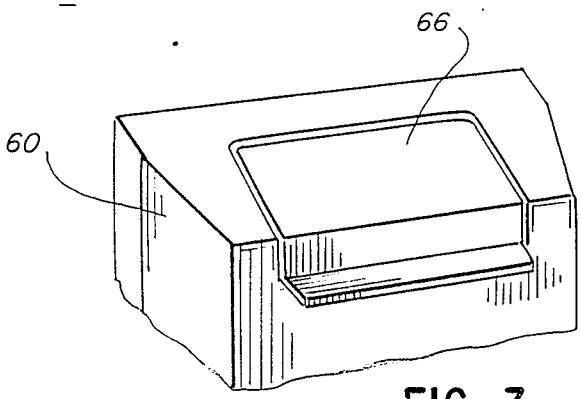
FIG. 3

FIG. 10
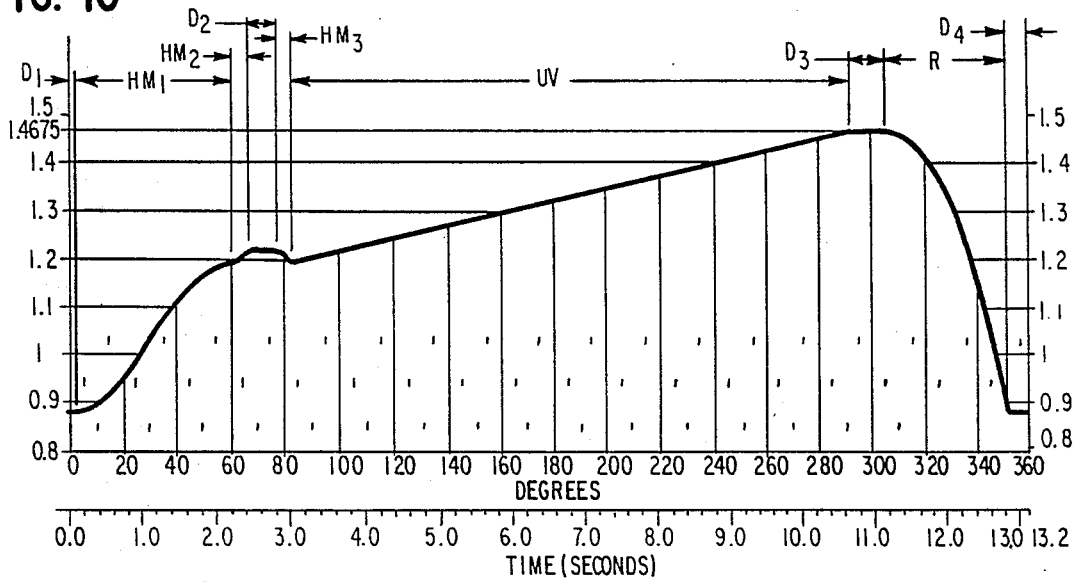
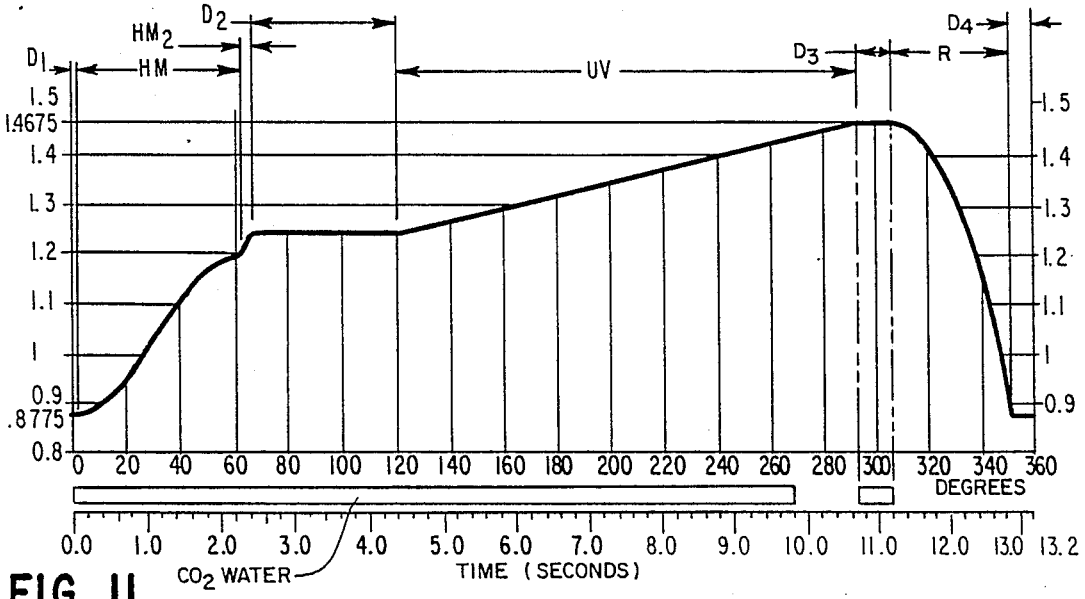
FIG. 11
FIG. 27
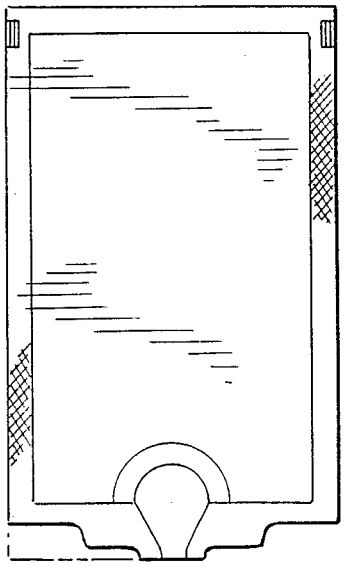

FIG. 14
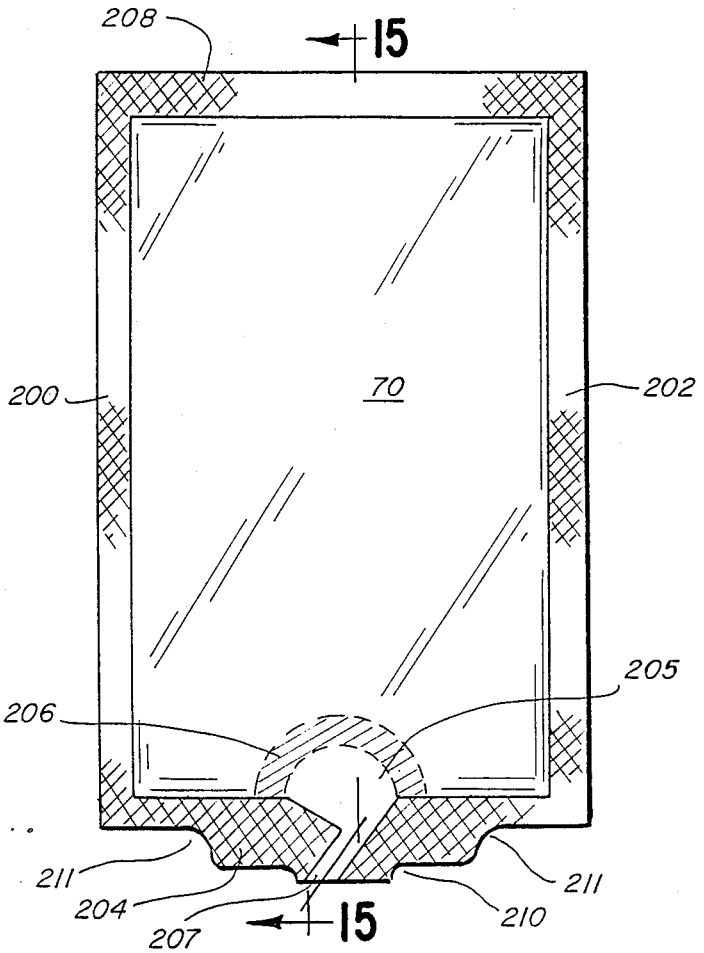
FIG. 15
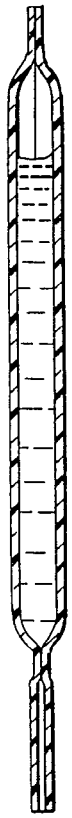
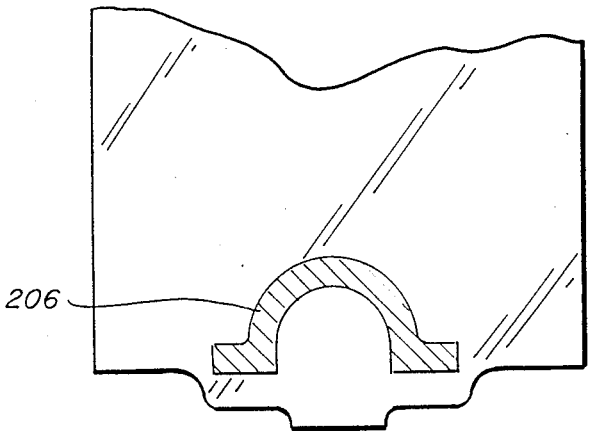
FIG. 16
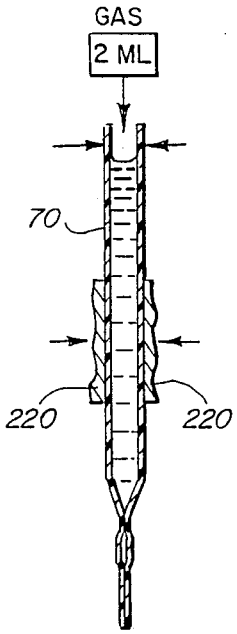
FIG. 28
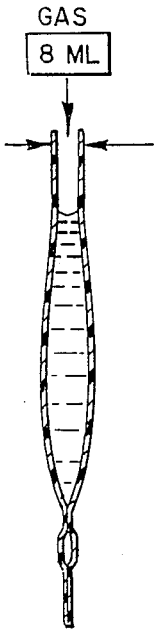
FIG. 29

FIG. 17
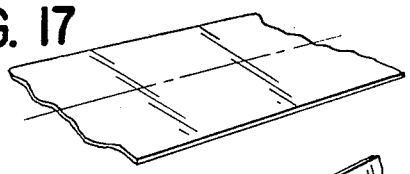
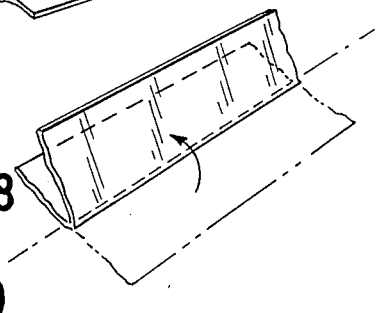
FIG. 18
FIG. 19
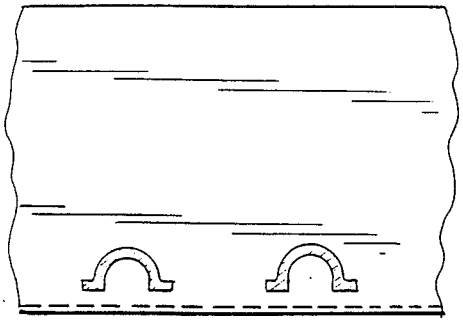
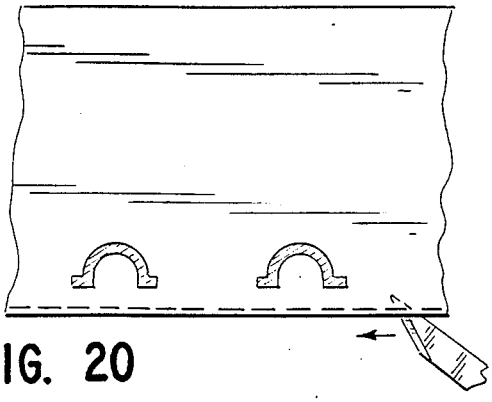
FIG. 20
FIG. 21
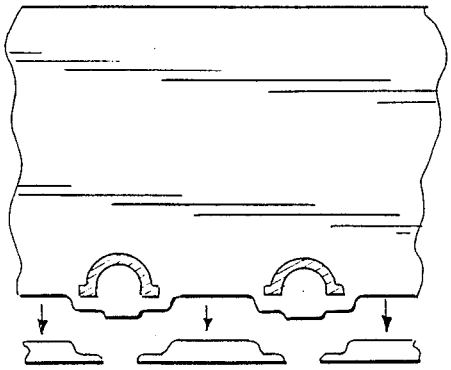
FIG. 22
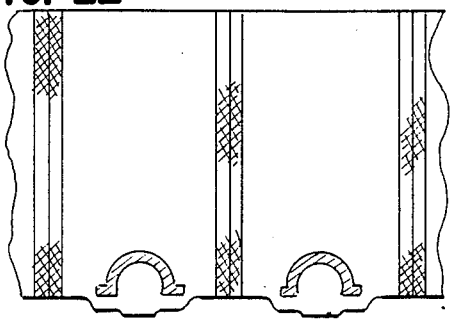
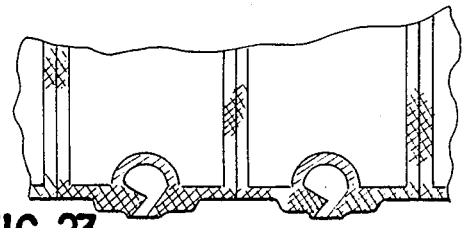
FIG. 23
FIG. 24
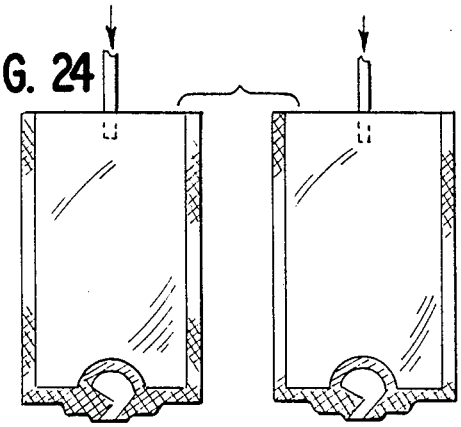
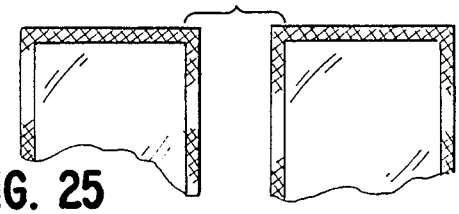
FIG. 25
FIG. 26
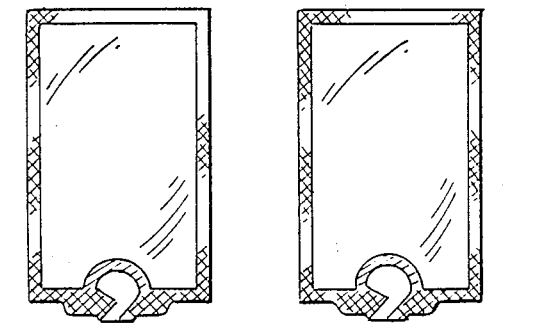

FIG. 30
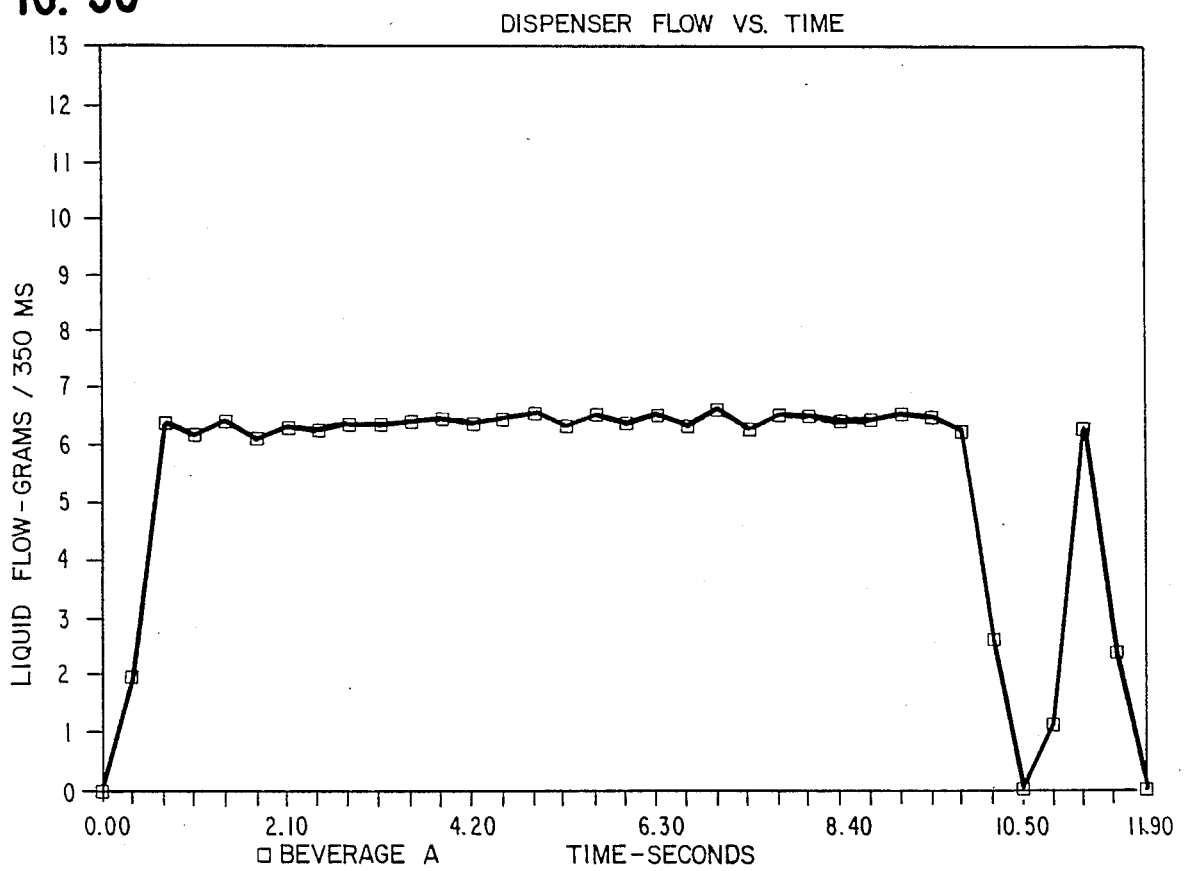
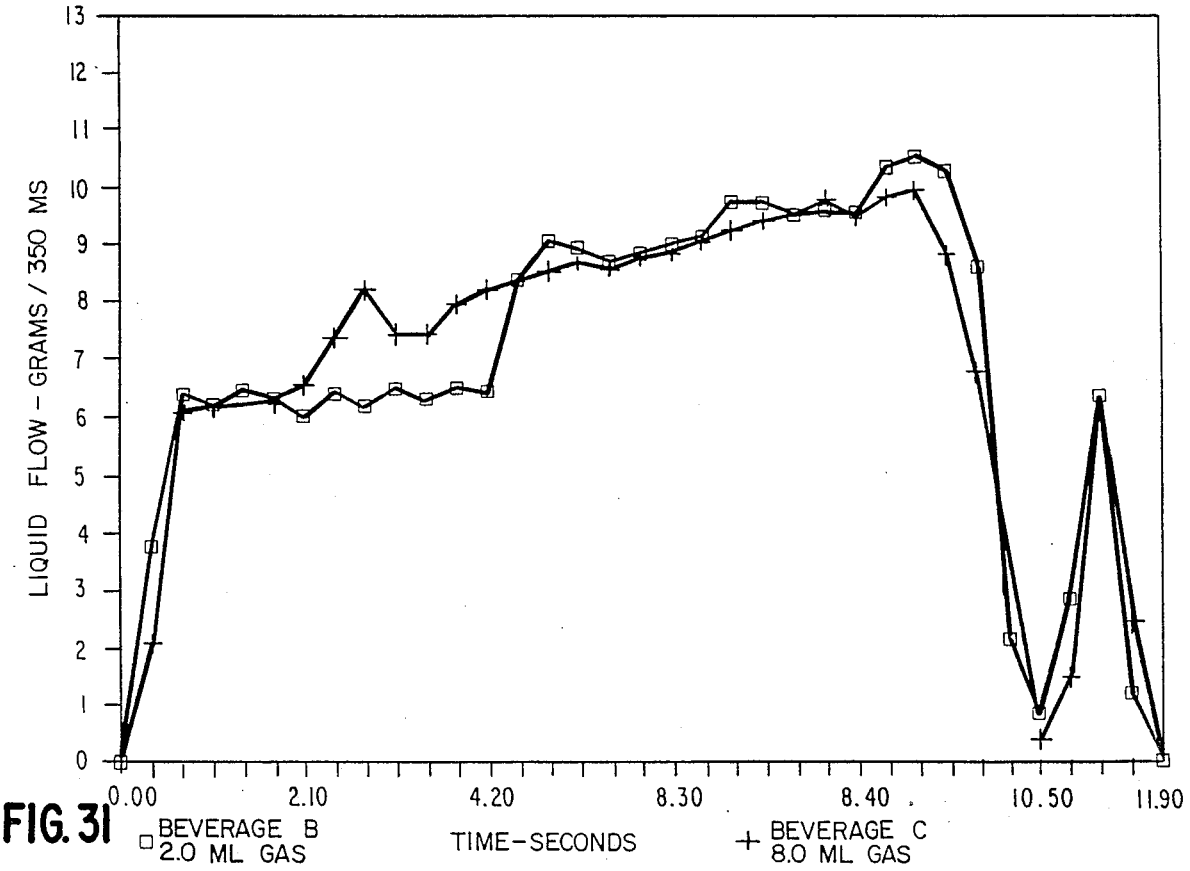
FIG. 31

APPARATUS AND METHOD FOR DISPENSING AN INDIVIDUAL BEVERAGE SERVING

BACKGROUND OF THE INVENTION

The present invention is directed generally to an apparatus and method for dispensing beverages. More particularly, the invention is directed to an improved beverage dispensing system and its method of operation in which a base liquid is mixed with a flavoring constituent contained in a collapsible and rupturable packet. The invention finds particular and advantageous use in dispensing carbonated beverages in which the base liquid is carbonated water and the flavoring constituent is a sweetened or unsweetened syrup, a juice concentrate or other flavoring.

In recent years, there has been an ever increasing proliferation of soft drink varieties introduced to the market. Carbonated oft drinks in many different flavors are now commonly available, as well as a variety of flavored seltzers, sparkling waters and lightly carbonated juice drinks. This great increase in the varieties of soft drinks poses a serious problem to those who desire to inventory a variety of flavors for later consumption. The problem is, of course, exacerbated where a number of consumers with widely varying tastes are placed in a common location, such as an office, factory or other workplace. Soft drinks typically consumed in the workplace are carried to it as cans or bottles, or are purchased off-site by employees and carried into the workplace for immediate or later consumption. This system of delivery of beverages to the workplace is often inefficient, and can be expensive due to the high cost of canned or bottled beverages and the relatively large space normally required to inventory and refrigerate these beverages.

As a result of these problems, there has been interest in recent years in the development of beverage dispensing systems in which a packet containing an individual serving of a flavoring constituent is used with an on-site dispenser. The packets are small and lightweight and can be inventoried in a large number of flavors without requiring a significant amount of space. Such a beverage dispensing system can potentially satisfy the individual tastes of a relatively large number of consumers without the disadvantages and constraints imposed by conventional dispensing systems.

There have been two such beverage dispensing systems which employ rupturable or collapsible packets disclosed in the prior art. One is that disclosed in U.S. Pat. No. 4,163,510 issued to Strenger and the other is disclosed in U.S. Pat. No. 4,220,259 issued to Lagneaux. Each of these prior art systems is intended to address the above noted problems in beverage distribution. However, neither has proven satisfactory in the marketplace. It is believed that the primary reason for these prior art systems' lack of success is their inability to consistently dispense a uniformly mixed, high quality soft drink. Specifically, it is essential that any dispensing system have the capability of repeatedly dispensing a beverage with acceptable temperature, carbonation and Brix. Thus, there remains a need for an on-site, individual serving packet beverage dispensing system having the capability to consistently dispense drinks of uniform high quality.

SUMMARY OF THE INVENTION

The present invention is directed to both a system and method for dispensing an individual serving of a beverage containing both a liquid flavoring constituent and a base liquid. The apparatus of the present invention overcomes the disadvantages of prior art systems and is capable of repeatedly dispensing a drink of uniform high quality. This capability comes from the recognition that a subtle but very important relationship exists between the design and construction of the flavoring packet, on the one hand, and the design and function of the dispensing apparatus on the other. Thus, it is important that the packet and dispensing apparatus be compatibly designed to provide precise control over the discharge of flavoring constituent from the packet during the dispensing cycle. The dispensing system must control not only the time during which flavoring constituent is discharged, but also the rate at which the flavoring constituent is discharged and the direction in which it is discharged. Moreover, it is important to control the manner in which the discharge of flavoring constituent stops at the end of the dispensing cycle. Precise control of these operations requires not only unique and special packet specifications but also unique and significantly improved dispenser construction and operation.

It is therefore one object of the present invention to provide an improved system for dispensing individual servings of a beverage containing both a liquid flavoring constituent and a base liquid. It is a further object of the invention to provide an improved beverage dispensing system in which individual servings of the flavoring constituent are packaged in a collapsible and rupturable packet.

It is another object of the present invention to provide a uniquely constructed and specially filled packet which assists in achieving uniform and high quality beverage servings.

A still further object of the present invention is to provide a uniquely constructed dispensing apparatus which utilizes a mechanically driven platen in order to achieve precise control over the discharge of flavoring constituent during the dispensing cycle.

Still another object of the present invention is to provide a uniquely constructed dispensing nozzle which not only properly mixes the flavoring constituent with the base liquid, but also assists in controlling the uniformity of beverage quality from serving to serving and even with different flavoring constituents.

In one preferred form, the beverage dispensing system of the present invention includes a packet containing a predetermined volume of the flavoring constituent and a predetermined volume of gas; means for delivering the base liquid to a dispensing nozzle; a packet rupturing mechanism including a movable platen to discharge the flavoring constituent from the packet and into the dispensing nozzle; and a platen drive means for moving the platen in a preselected manner dependent upon the predetermined volumes of the flavoring constituent and gas within the packet. Thus, the platen is driven to rupture the packet during the dispensing cycle in a manner which depends upon the predetermined volumes of flavoring constituent and gas contained within the packet.

BRIEF DESCRIPTION OF THE DRAWINGS

The novel features which are believed to be characteristic of the invention are set forth in the appended claims. The invention itself, however, together with further objects and its attendant advantages, will be best understood by reference to the following description of the preferred embodiments taken in connection with the accompanying drawings in which:

FIG. 1 is a perspective view showing one preferred arrangement of a beverage dispensing system constructed in accordance with the present invention and incorporated into a conventional bottled water dispensing unit;

FIG. 2 is a perspective view illustrating the manner in which the individual serving packet containing the flavoring constituent is inserted into the rupturing mechanism of the apparatus and showing in phantom a typical individual serving container positioned below the nozzle of the dispensing unit;

FIG. 3 is a partial perspective view illustrating the arrangement of the cover for the packet rupturing mechanism;

FIG. 10 is a graph illustrating the movement of the platen during a dispensing cycle as controlled by virtue of the cam illustrated in FIG. 9;

FIG. 11 is a graph similar to that of FIG. 10 but showing the movement of the platen as controlled by another preferred cam design constructed in accordance with the present invention;

FIG. 14 is a front view illustrating one preferred packet design used in accordance with the present invention;

FIG. 15 is a cross-sectional view taken along line 15—15 of FIG. 14;

FIG. 16 is a front view showing a portion of the packet of FIG. 14 and its peel seal during an intermediate stage in the packet's construction;

FIGS. 17 through 26 are schematic views that illustrate a preferred sequence of steps utilized in the manufacture of a packet for use in accordance with the present invention;

FIG. 27 is a front view similar to that of FIG. 14 but showing another preferred packet design used in accordance with the present invention;

FIGS. 28 and 29 are cross-sectional views illustrating schematically one method for adjusting the gas head space contained within a packet in accordance with the practice of the present invention;

FIG. 30 is a graph illustrating the flow of base liquid through the dispensing unit during a typical dispensing cycle; and FIG. 31 is a graph illustrating the flows of various flavoring constituents and base liquids through the dispensing unit during typical dispensing cycles in accordance with the practice of the present invention.

DETAILED DESCRIPTION OF THE PREFERRED EMBODIMENTS

Figure 4:
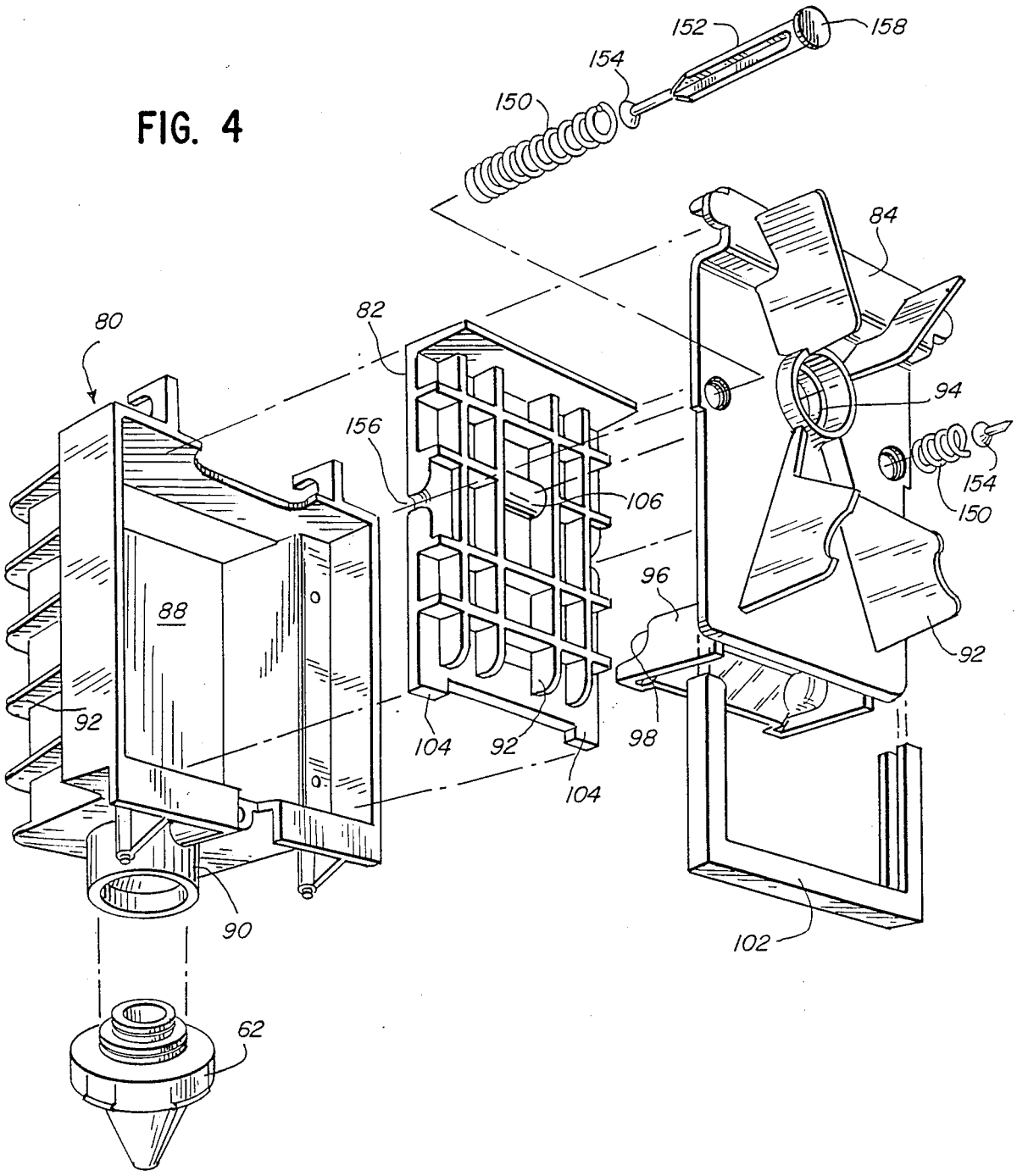
FIG. 4 is a perspective view of the internal components of the packet rupturing mechanism shown in exploded relation.

Referring now to FIGS. 1 through 3, a conventional bottled water dispenser 50 is shown and in which the apparatus of the present invention is incorporated with particular advantage. The bottled water dispensed 50 typically includes hot and cold water spigots, 52 and 54 respectively, and internal systems for chilling or heating the water as it is dispensed from bottle 56. In accordance with the present invention the dispenser 50 incorporates a packet receiver 60 and a nozzle 62 through which the flavoring constituent and base liquid are delivered to a cup or other individual beverage serving container 64. The dispenser 50 also includes a conventional carbonation system which may be selected from any one of a number of such carbonation systems well known to those of ordinary skill in the art. The packet receiver 60 includes a pivotable cover 66 which, when opened, provides access to a mechanism that acts to discharge the flavoring constituent from the packet 70 when a beverage serving is to be dispensed. While the present invention is being described as incorporated in a bottled water dispenser, the invention is not so limited. Rather, the apparatus and method of the present invention may be suitably employed with any base liquid or water dispensing system, including those that make use of tap water.

In accordance with the present invention, it is desireable that the packet receiver 60 be easily disassembled in order to facilitate periodic cleaning. To that end, the external housing 72 of the packet receiver may be conveniently designed to snap fit to the dispenser cabinetry or may be otherwise mounted by use of hand actuated fasteners in order to be easily removed.

The packet receiver 60 includes a rupturing mechanism which is shown in detail in FIGS. 4–8. The rupturing mechanism is made up of a platen housing 80, platen 82 and back plate 84 and related components. The housing 80 is constructed with a fixed wall 88 and a bottom having a discharge port 90. Discharge port 90 also communicates with a base liquid supply conduit or passageway 91 formed in the base of housing 80. When the housing is properly mounted to dispenser cabinet wall 51 the passageway 91 mates with a base liquid supply nozzle (not shown). Back plate 84 includes an opening 94 for receipt of the platen shaft whose structure and operation will be described in further detail below. Back plate 84 also includes a lower pedestal 96 which includes packet stops 98 and a shoulder or platen stop 100 all of whose function will be described below. The back plate 84 is surrounded along the lower half of its perimeter by a gasket 102, and the back plate and gasket together nest within housing 80 in press fit relation. The platen 82 is disposed within the housing between fixed wall 88 and back plate 84 with its lowermost feet 104 positioned adjacent the platen stop 100. In this way, movement of the platen at its lowermost end is limited to the horizontal space between fixed wall 88 and shoulder stop 100. The platen 82 also includes a cylindrical shaft engaging surface 106 which is configured to accommodate the free end of the platen shaft. Preferably, the housing, back plate and platen are constructed from a lightweight plastic and include reinforcing ribs 92 to provide sufficient strength to withstand the forces generated during the dispensing cycle.

The packet rupturing mechanism is mounted to the external cabinetry of the dispenser, such as cabinet wall 51, by any conventional fastening elements, and preferable manually operated fastening elements which will permit the easy removal of the rupturing mechanism for purposes of cleaning and service.

Also illustrated in FIGS. 5–8 is a platen drive mechanism which includes a motor 110, a cam 112, a cam follower 114 and platen shaft 116. The motor 110 and cam 112 are mounted to a drive mechanism mounting plate 120 which in turn is adjustably mounted to the inside of the dispenser cabinet wall 51. In any single dispensing cycle the cam 112 will rotate about cam shaft 113 (in a clockwise direction as illustrated in FIGS. 5–8) through 360°.

The mounting plate 120 is assembled to the inside of the dispenser cabinet wall 51 by means of bolts 130 and 132. As illustrated the bolt 130 is located at the upper perimeter of mounting plate 120 while bolt 132 is located at the lower perimeter of the mounting plate. Sandwiched between the drive mechanism mounting plate 120 and the cabinet wall 51 is an elastomeric mounting block 134 which is compressed to some extent by tightening bolt 130. In addition, an override compression spring 136 is mounted over bolt 132 and acts to urge or bias the entire drive mechanism toward cabinet wall 51. The biasing force generated by spring 136 is greater than that required to rupture packet 70 during a typical dispensing cycle. The mounting plate 120 is retained in a slightly spaced relation from cabinet wall 51 by virtue of a stop 140. The precise location of cam 112, and therefore the location of platen 82 in relation to fixed wall 88, may be adjusted simply by tightening or loosening adjustment bolt 130. This permits fine tuning of the dispenser geometry to properly operate with a given packet configuration.

Figure 5:
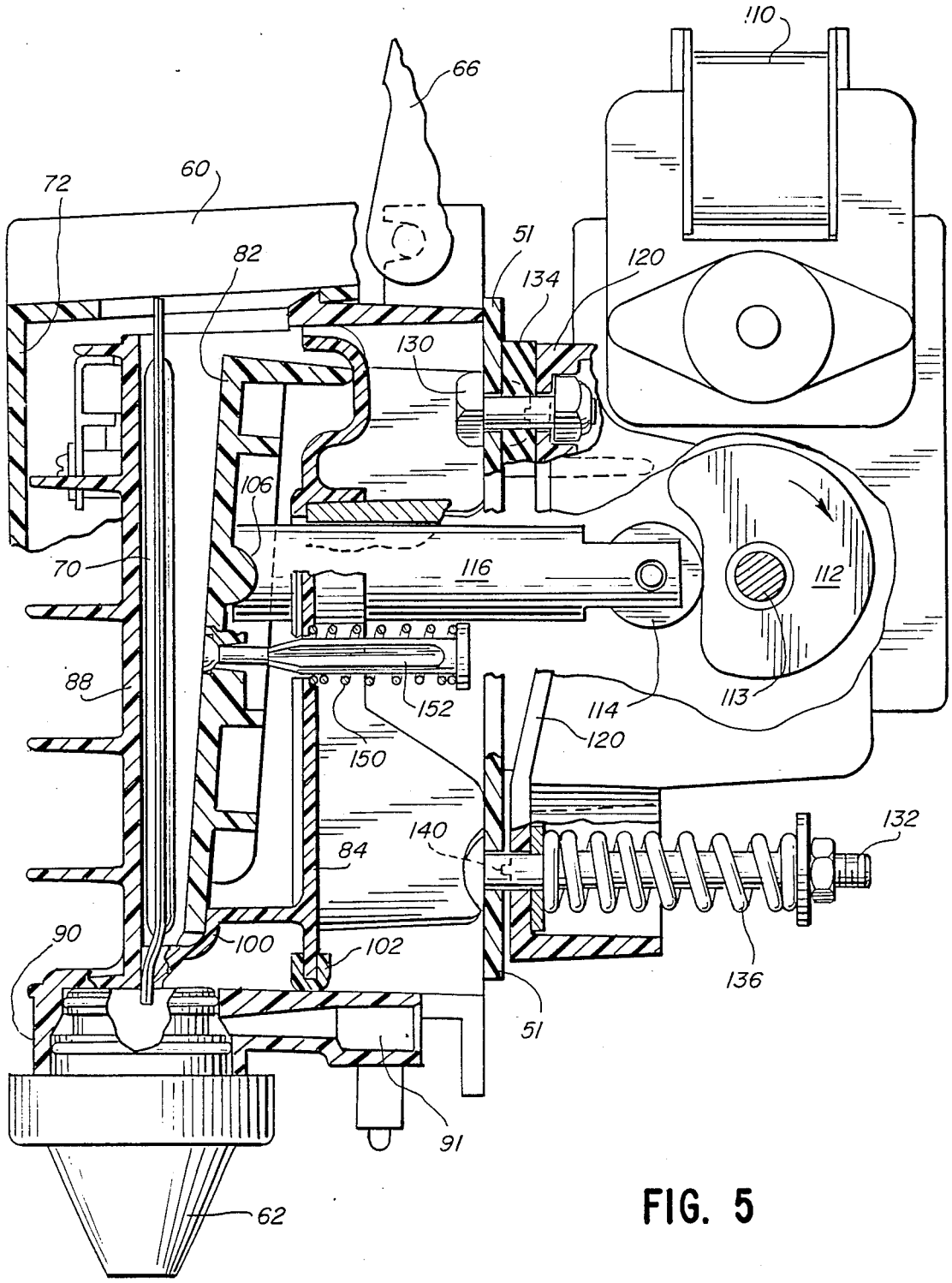
FIG. 5 is a side elevational view in partial cross-section showing the packet rupturing mechanism and its associated drive mechanism in the open or initial packet receiving position during the dispensing cycle.

In operation during a dispensing cycle, the rupturing mechanism is disposed initially in an open packet receiving position as illustrated in FIG. 5. Upon actuation of the drive mechanism cam 112 begins to rotate in a clockwise direction, causing cam follower 114 and its associated platen shaft 116 to move in a direction toward fixed wall 88. Because of the configuration of cam 112, the cam follower 114 and platen shaft 116 will move rapidly and thereby pivot or tilt platen 82 to the intermediate packet rupturing position illustrated in FIG. 6. Continued rotation of the cam 112 causes the platen 82 to move at a slower rate from the intermediate packet rupturing position to the final closed position illustrated in FIG. 7.

The packet rupturing mechanism is provided with a platen retraction means including retraction springs 150 which ride on pins 152. The pins 152 each include a head 154 at one end which is nested within a pin seat 156 in the platen. The pins also include a flange 158 at the other end. As is clearly illustrated in FIGS. 6 and 7, as the platen 82 moves from the initial open position during the dispensing cycle toward the closed position the retraction pins are carried with it, thereby causing the retraction springs 150 to be compressed. Accordingly, when the cam 112 has rotated through a complete cycle the retraction springs, acting through the retraction pins 152, cause the platen 82 to return to the open position. In effect, the retraction springs act to urge platen 82 away from fixed wall 88 and the platen shaft 116 through cam follower 114 into engagement with cam 112 throughout the dispensing cycle. The biasing force generated by retraction springs 150 is less than the biasing force generated by spring 136.

Figure 6:
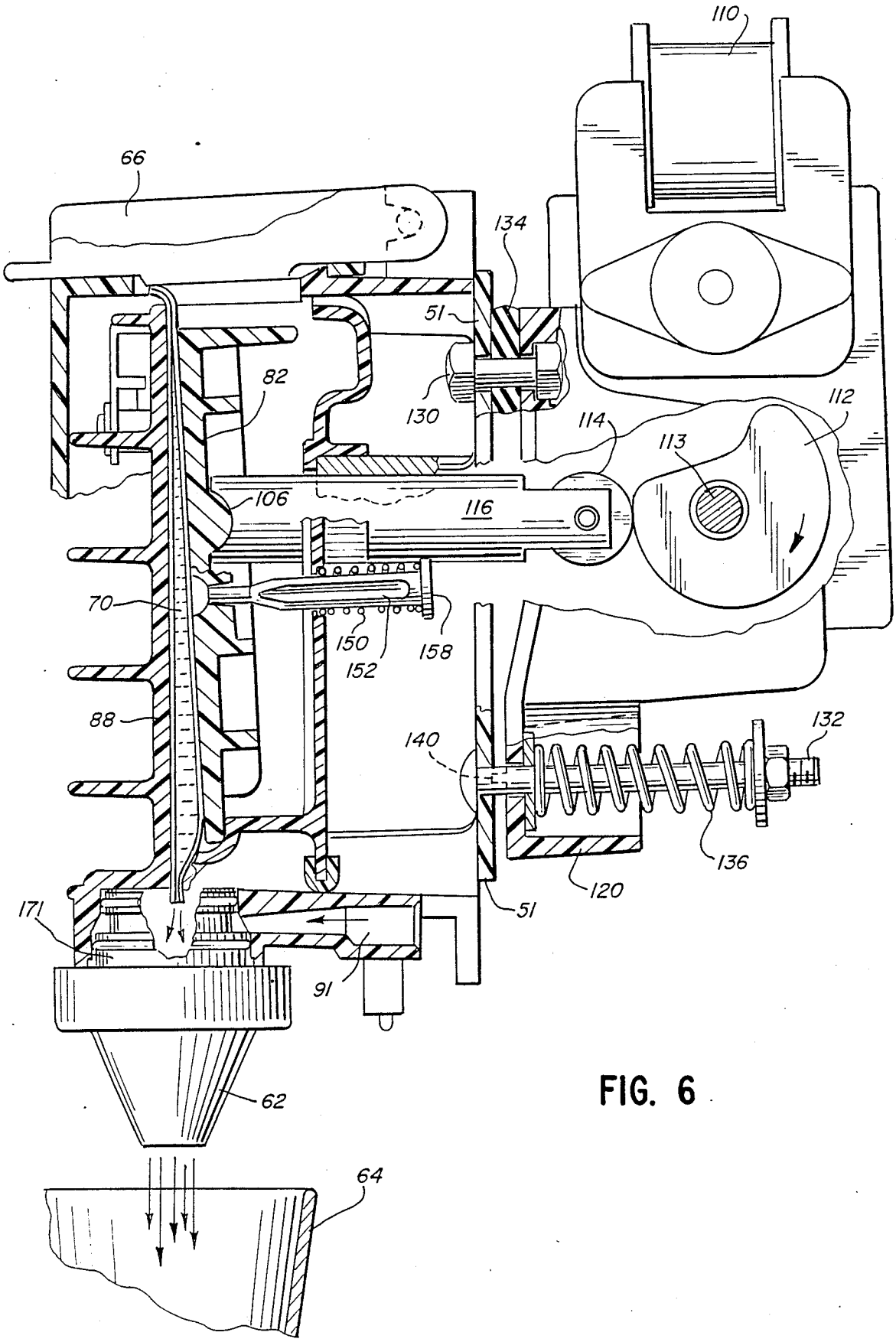
FIG. 6 is a view similar to that of FIG. 5 but showing the packet rupturing mechanism and its related drive mechanism in an intermediate packet rupturing position.

It should be noted that the retraction springs 150 are positioned at a generally central location along the vertical extent of platen 82 whereas platen shaft 116 is positioned to engage the platen at a point vertically above the retraction springs. Thus, the force acting on platen 82 through shaft 116 creates a moment arm that causes platen 82 to first pivot about its feet 104 from the open position shown in FIG. 5 to the packet rupturing position shown in FIG. 6. In this way, the upper end of platen 82 moves toward fixed wall 88 before the lower end begins to move during the dispensing cycle. This method of operation insures that the packet 70 will increase in thickness and form a pool of flavoring constituent, as shown in FIG. 6 at a point adjacent the peel seal; this, in turn, generates greater peeling or rupturing forces within the packet at the peel seal. One advantage to this arrangement is that greater control is achieved over the precise timing of initial flavoring discharge during the dispensing cycle.

Figure 7:
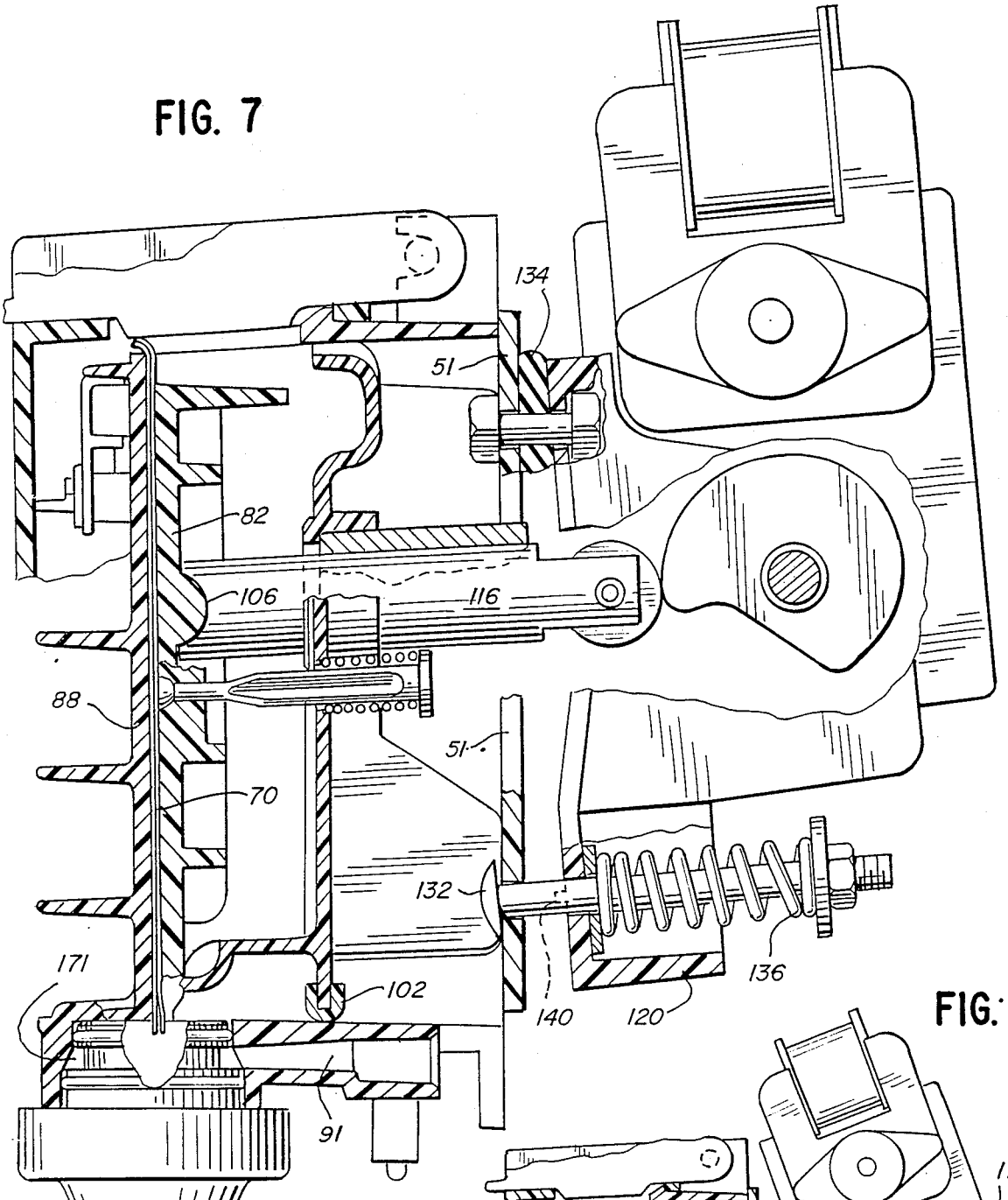
FIG. 7 is a view similar to those of FIG. 5 and 6 but showing the packet rupturing mechanism and its associated drive mechanism in the closed or final position during the dispensing cycle.

As best illustrated in FIG. 7 when the platen 82 has reached its closed position the packet 70 will have been completely collapsed thereby discharging substantially all of the flavoring constituent contained within it. Moreover, a repeatedly consistent platen closure force is assured because, as cam 112 rotates through its highest point as illustrated in FIG. 7, the entire drive mechanism pivots on mounting block 134 away from the cabinet wall 51 and against the compressive or biasing force generated by spring 136

Figure 8:
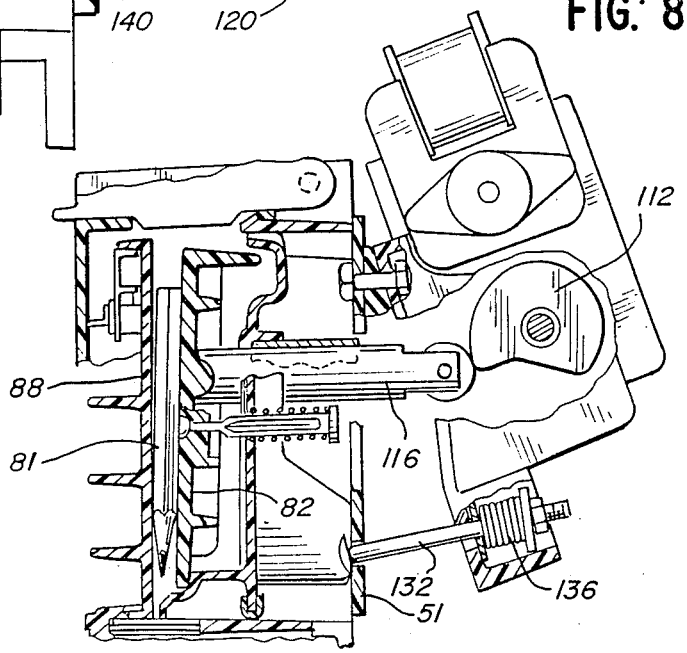
FIG. 8 is a view similar to FIGS. 5–7 but showing an obstruction in the packet rupturing mechanism and the operation of the drive mechanism override.

As illustrated in FIG. 8, the preferred mounting arrangement of the drive mechanism is such that obstructions placed within the rupturing mechanism will not cause damage to any of the components of the system. When an obstruction 81 is encountered between the fixed wall 88 and platen 82 the drive mechanism will move or pivot away from cabinet wall 51 and against the compressive force of override spring 136. Thus, a fail-safe drive mechanism is achieved.

In accordance with an important aspect of the present invention, the platen drive means through the configuration of cam 112 provides for both rapid movement of the platen from an open position to the intermediate packet rupturing position and thereafter slow movement of the platen to the closed position immediately adjacent the fixed wall 88. Moreover, the cam 112 may preferably have a configuration which causes the platen to stop its movement toward fixed wall 88 for a preselected time period immediately after the platen has reached the packet rupturing position. Alternatively, and depending upon the specific packet design used with the system, the cam 112 may have a configuration which causes the platen to move away from fixed wall 88 a preselected distance immediately after the platen reaches the packet rupturing position but before moving the platen again toward the final closed position.

Figure 9:
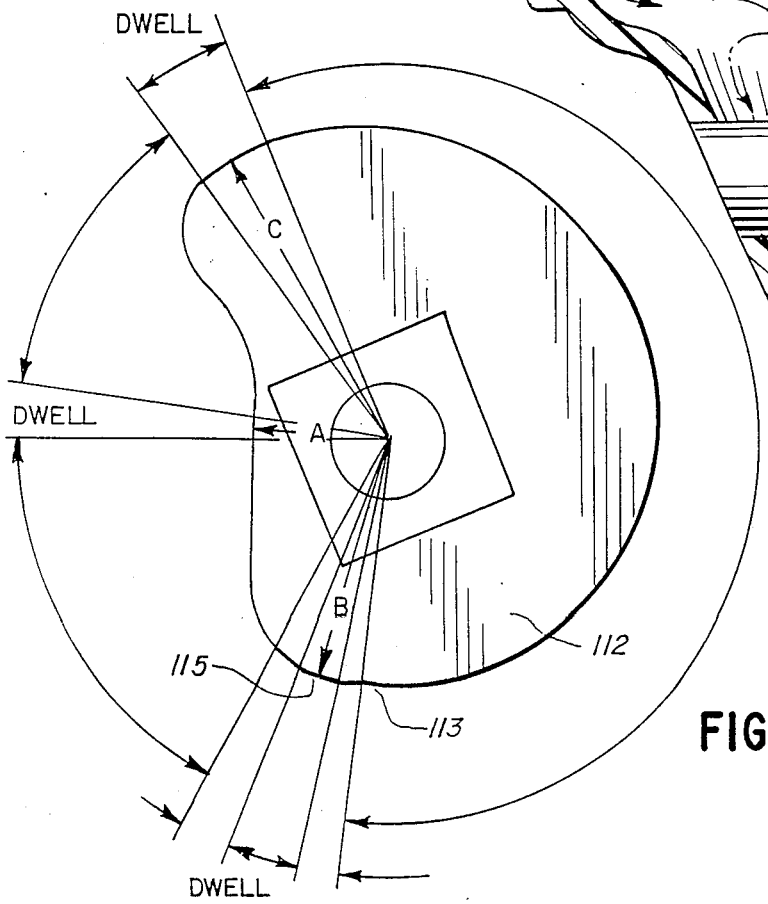
FIG. 9 is a side elevational view showing the details of construction of one cam used in one preferred embodiment of the drive mechanism of the present invention.

FIG. 9 illustrates a specific cam configuration which will achieve a platen movement during the dispensing cycle as illustrated in the graph of FIG. 10. In accordance with this cam design, the platen will have an initial rapid movement from the open position to the packet rupturing position, will then move away from fixed wall 88 a preselected distance, and will thereafter move at a slow and continuous rate to the final closed position. This particular configuration for cam 112 and the resulting movement of the platen has been found particularly advantageous when using packets of a particular configuration and design, typically with a head space of from about 5 to 10 milliliter, which will be discussed in greater detail hereinafter. Similarly, FIG. 11 shows platen movement using a cam having a different configuration from that of FIG. 9. Namely, the cam used to achieve this motion does not cause the platen to retract or back off from the fixed wall 88 immediately after reaching the packet rupturing position. Instead, the platen remains stationary for a preselected time period after reaching the packet rupturing position, before then once again beginning its travel toward fixed wall 88. This particular cam design and platen movement has been found more suitable with packets having very little head space from about 0–5 milliliters.

Figure 12:
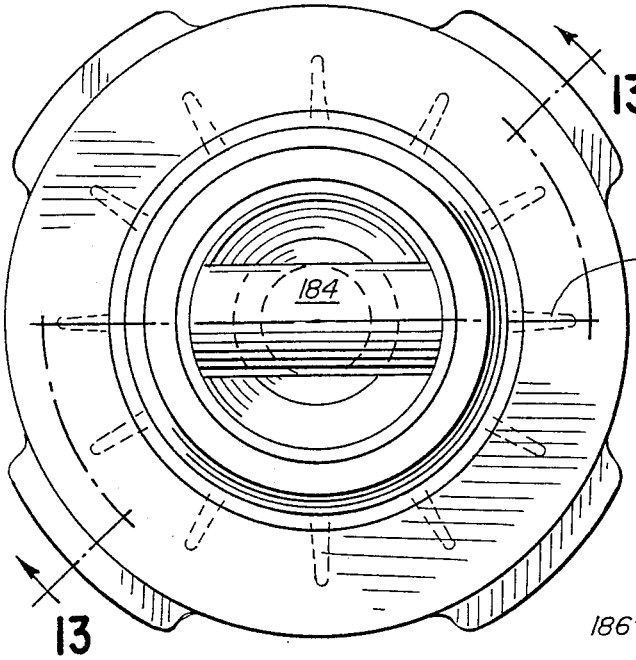
FIG. 12 is a top view illustrating a preferred nozzle design constructed in accordance with the present invention.
Figure 13:
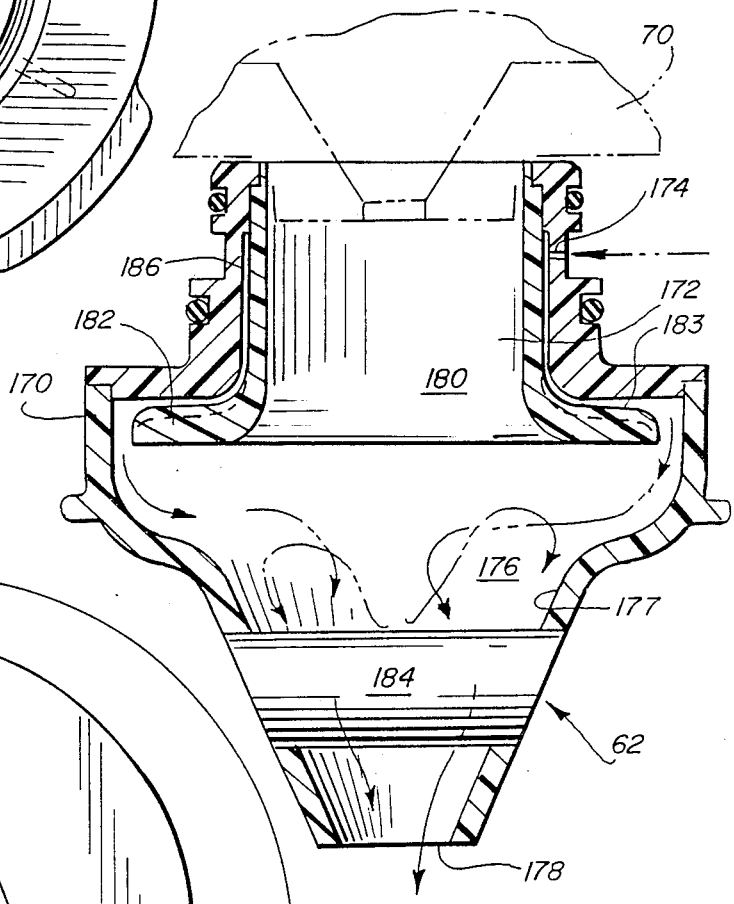
FIG. 13 is a cross-sectional view taken along line 13—13 of FIG. 12 and illustrating the flow path of flavoring constituent and base liquid through the nozzle during a typical dispensing cycle.

FIGS. 12 and 13 illustrate a unique nozzle construction found particularly advantageous in the practice of the present invention. The nozzle 62 includes an outer shell 170 having a neck 171 defining a first inlet 172, one or more second inlets 174, a mixing zone 176 with mixing surface 177 and a discharge port 178. Mounted concentrically within the neck 171 of shell 170 is an insert 180 which includes a radially extending skirt or deflector 182 having a series of radially extending ribs 183. Also positioned within outer shell 170 is a deflector 184 which extends diametrically across the mixing zone 176. Deflector 184 preferably has a thickness or lateral dimension at least equal to the diameter of discharge port 178, and is positioned vertically to provide adequate flow of base liquid over its surfaces in order to assure complete rinsing of the flavoring constituent at the end of the dispensing cycle. As best illustrated in FIG. 13, insert 180 is concentrically mounted within shell 170 but spaced from it to create an annular passageway 186 which communicates with the second inlet 174. Nozzle 62 has an outside diameter at its inlet sized for insertion in press fit relationship within discharge port 90 of the platen housing. O-rings 190 and 191 on the neck 171 of nozzle 62 seal the nozzle within discharge port 90. The second inlet 174 is in direct communication with the base liquid supply conduit 91 and therefore receives the base liquid under relatively high pressure during the dispensing cycle. The manner in which the flavoring constituent and base liquid flow through and mix within nozzle 62 will be discussed in greater detail below.

In accordance with the present invention the packet 70 which contains a flavoring constituent must be designed to satisfy various important design criteria. For example, it is important that the packet contain the flavoring constituent throughout shipping and storage without accidental rupture and leakage, and yet it must reliably open and discharge the entirety of its contents when used in combination with the package rupturing mechanism described above. Therefore, it is important that the seals used to form packet 70 be designed to achieve these results. In accordance with these objectives the packet 70 comprises front and back film laminates 71 and 73 having side seals 200 and 202, a lower or spout seal 204, a peel seal 206 and a closure seal 208. It has been found particularly advantageous in the design of packet 70 that the side seals 200 and 202 and spout seal 204 have a strength greater than that of the peel seal 206 but less than that of the closure seal 208. Ideally, the peel seal requires a force in the range of 1 to 2.5 pounds per inch to be opened. Most preferred is a force of approximately 1.9 to 2.0 pounds per inch to open the peel seal. Given this peel seal specification, the side seals 200 and 202 and spout seal 204 are designed to require a force in excess of 2.5 pounds and up to as much as 3.5 pounds per lineal inch in order to fail. Consistent with these specifications the top or closure seal 208 requires a force of 3.75 to 5 pounds per lineal inch to cause failure. These seal strength values can be achieved by a variety of means well known to those of ordinary skill in the art. For example, when using heat bondable laminates, use of differing temperatures in the seal platens will provide the desired variation in seal strengths. This combination of seal strength values provides a fail safe method of opening the packet. This is accomplished by keeping the side seal values greater than the peel seal values and below the closure seal values. Thus, if there is an obstruction in the packet nozzle area, the side seal will fail before the closure seal. This significantly decreases the possibility of the flavoring constituent exiting through the top of the dispenser during a failure of the dispensing unit.

As shown in FIG. 14, the packet 70 may include a discharge spout 205 defined by spout seal 204 includes an angled section 207. The purpose of the angled discharge spout illustrated in FIG. 14 is to insure that the flavoring constituent will not pass straight through the nozzle 62 along the longitudinal axis of the packet during the dispensing cycle, but rather will be directed laterally toward the interior mixing surface 177 of nozzle 62 for reasons to be described in greater detail below.

As shown in FIG. 16, the peel seal 206 is generally of a horseshoe configuration which permits the more effective peeling or opening of the seal under the forces exerted by the rupturing mechanism of the dispenser. It should also be noted that the packet includes a narrow extension 210 which as shown in FIGS. 5–7 is positioned below the uppermost edge of nozzle 62 during the dispensing cycle. In this way, it is very difficult if not impossible for any flavoring constituent to flow or discharge from the system other than directly through nozzle 62.

The packet 70 also includes cut-outs or notches 211 which accommodate packet stops 98 of the platen housing. The mating or nesting of the packet notches 211 with stops 98 assures that the packet is properly oriented within the packet receiver. If the packet is inserted into the packet receiver upside down, then packet stops 98 will raise the packet thereby preventing complete closure of the cover 66. In turn, a safety switch actuated by cover 66 cannot be closed and the dispenser cycle cannot be started. Thus, the packet notches and stops operate as a failsafe mechanism to insure proper packet placement.

FIGS. 17–26 illustrate one preferred method of constructing the packets used in accordance with the present invention. The material from which the packets are made can be any of a variety of packaging materials well known to those of ordinary skill in the art. The packets must form not only a barrier to fluids and gases but must also provide a flavoring barrier to insure that the flavoring constituent will not degrade during the anticipated shelf life of the packet. Typically the packaging material will include a polyester outside layer having suitable art work and printed material applied to its inside surface. Laminated to the polyester is an aluminum foil which may be typically adhered through the use of a low density liquid polyethylene. Finally, a low density polyethylene copolymer laminate is applied to the interior of the aluminum foil. This laminated sheet is then folded as shown in FIG. 18 and the peel seal is applied as shown in FIG. 19 at a location closely adjacent to the folded edge. Next, the folded edge is slit as illustrated in FIG. 20 and the folded edge is severed by dye cutting as shown in FIG. 21, thereby forming extension 210 and notches 211. Next, the side seals and spout seals are formed as shown in FIGS. 22 and 23, respectively. The packets are then cut into individual units, filled with an appropriate flavoring constituent and finally completely closed by application of the closure seal. It is preferred that the filling of the packet with the specific flavoring constituent and the application of the closure seal to completely enclose the packet all be conducted in an inert environment thereby assuring that minimal amounts of oxygen will be contained within the packet. Thus, the potential degradation of the flavoring constituent due to oxidation is minimized.

In accordance with an important feature of the present invention, the volume of flavoring constituent and gas contained within the packet 70 is carefully controlled. Of course, it is important that the amount of flavoring constituent within the packet be precisely measured in order to assure the proper flavoring of the finished beverage serving dispensed from the apparatus. However, it is important to control the volume of gas contained within the packet as well. It has been found that the volume of gas maintained within the packet has far reaching implications with respect to the performance of the packet and the ability to consistently dispense individual beverage servings of high quality. For example, it has been determined that the volume of gas contained within packet 70 should be less than 10 milliliters. Most preferably, the amount of gas contained within the packet 70 should be reduced to an absolute minimum, less than about 5.0 milliliters and, to the extent possible, approaching a complete absence of gas, less than 1.0 millimeter of gas, or what is commonly referred to as "a zero head space".

It has been found that a packet with a zero head space provides significant advantages. For example, greater consistency is achieved in the opening time or rupturing time of the packet and the control over the initial burst or flow rate of flavoring constituent. Additionally, extended shelf life is achieved by minimizing the foreign gaseous contaminants within the packet. The reduction in volume of gas within the container allows for a smaller package with its concomitant reduction in cost. Where the packet is filled and closed within an inert environment such as nitrogen, the amount of nitrogen consumed is reduced. The noise generated by the rupturing or bursting of the packet is also minimized when the gas head space is small. Finally, it has been found that the sputtering or splashing of flavoring constituent at the very end of the discharge from the packet is minimized or eliminated entirely. This is significant in that spluttering or splashing causes potential sanitary problems by the accumulation of flavoring constituent in portions of the nozzle that are not rinsed by the base liquid.

The packet head space, that is, the gas volume within the packet, has some effect upon the uniformity of discharge rate of flavoring constituent throughout the dispensing cycle. Because gas is a compressible fluid and liquids are relatively incompressible, with a larger gas head space of from about 5 to 10 milliliters, the packets exhibit a greater gas spring effect upon rupturing which results in less control over discharge flow rate. This gas spring effect can be alleviated to some extent, by use of a cam of the type illustrated in FIG. 9 which includes a reduced radius or recess 113 immediately following the packet rupturing segment 115 of the cam. As a result of this cam configuration, the platen 82 will move away from wall 88 for a preselected distance, for example, 0.020 to 0.025 inches, before resuming its forward movement toward wall 88 in the dispensing cycle.

Packets with minimal head space, less than about 5 milliliters have less gas spring effect and, therefore, a cam may be used without a recess 113. Nevertheless, a cam with a dwell period at the rupturing segment and giving platen movement as depicted in FIG. 11 has been found most effective to achieve a uniform discharge rate for flavoring constituent.

Therefore, an important aspect of the present invention is the recognition that the platen movement during the dispensing cycle must be controlled in a preselected manner which depends upon the predetermined amounts of flavoring constituent and gas contained in the collapsible packet. Those of skill in the art will recognize that any one of a variety of different techniques may be employed to control or adjust the amount of head space to be contained within packet 70. FIGS. 28 and 29 schematically illustrate one such method. After a predetermined volume of flavoring constituent has been placed in the packet, side tamping device 220 may be brought into engagement with the sides of the packet until a preselected level of flavoring constituent is achieved. At that point the top closure seal is completed thereby entrapping a predetermined amount of gas within the packet.

FIG. 30 presents a graph showing the flow rate of base liquid, in this case carbonated water, through the complete dispensing cycle which is preferably about twelve seconds in duration. As can be seen in FIG. 30 the flow of base liquid begins within about one-half second after initiation of the dispensing cycle and continues at a generally constant flow rate until approximately nine seconds have elapsed in the cycle. At that point, the base liquid flow rate stops momentarily and then resumes for approximately one second which is termed the rinse period of the cycle.

FIG. 31 shows the flow rates for two beverages one being Beverage B and the other Beverage C during typical dispensing cycles. The only difference between the Beverage B and Beverage C is that the packet used for dispensing Beverage B contained 2.0 milliliters of head space whereas the packet used to dispense Beverage C contained 8.0 milliliters of head space. FIG. 31 illustrates that adjustment of the head space within the packet has an influence on the discharge of flavoring constituent during the dispensing cycle.

In the operation of the apparatus and method of the present invention a packet 70 is selected with the desired flavoring constituent and inserted into the packet receiver 60 of the dispensing unit. The cover 66 of the packet receiver is then closed and the dispensing cycle is initiated by actuation of a switch or button. During the initial portion of the dispensing cycle a base liquid is delivered via the base liquid supply conduit 91 to the second inlet 174 of nozzle 62. The base liquid then passes into the annular passageway 186 and is distributed circumferentially about the interior of the nozzle by means of the radial deflector 182 and its associated radial fins 183. This particular configuration of the nozzle finds significant advantage when employed with a carbonated water base liquid. The annular passageway 186 serves to distribute the carbonated water at a relatively high pressure and permits it to expand in a relatively quiescent zone on the upper surfaces of the deflector skirt 182. Because the carbonated water is flowing by virtue of gravity and is not flowing at a relatively high flow rate the amount of foaming and therefore loss of carbonation which occurs is minimized.

During this initial portion of the dispensing cycle, the cam 112 begins to rotate and, as a consequence, platen shaft 116 and platen 82 are moved rapidly toward the packet rupturing position. Thereafter, as the cam continues to rotate platen shaft 116 and platen 82 continue at a slower rate of speed to the fully closed position. During this aspect of the dispensing cycle, the flavoring constituent is completely discharged from packet 70 through the ruptured peel seal and spout into the first inlet of the nozzle 62. Upon discharge into the nozzle the flavoring constituent is directed either to mixing surface 177 or to the surfaces of deflector bar 184 where it mixes with the base liquid as it flows toward discharge port 178. It is important that the flavoring constituent not be directed onto the internal surfaces of the first inlet 172 of nozzle 62. These surfaces are not contacted by the base liquid and, as a result, any flavoring constituent contacting these surfaces will not be mixed into the beverage serving. Thus, a buildup of flavoring constituent may develop, resulting in potential contamination of later servings or sanitation problems.

Because the base liquid or carbonated water is relatively cold and the flavoring constituent is at room temperature, this mixing causes a foaming and concomitant loss in carbonation in the final beverage. Therefore, it is desireable that the mixing of base liquid and flavoring constituent take place in the nozzle and at the zone designed for this purpose, namely mixing zone 176. After the flavoring constituent has been completely discharged from the packet 70, the base liquid supply is momentarily cut off and then resumed for a brief period in order to thoroughly rinse the surfaces of the mixing zone 176 and diverter bar 184. The entire dispensing cycle is then completed as the cam completes its 360° rotation to the position shown in FIG. 5 and the platen 82 and platen shaft 116 are returned to the initial open position by means of retraction springs 150. FIG. 11 shows the relationship over time between the flow of base liquid (carbonated water) and platen movement during a typical dispensing cycle. FIGS. 30 and 31, on the other hand, show the relationship over time between the flow of base liquid alone (Beverage A in FIG. 30) and the total flow of base liquid and flavoring constituent (Beverages B and C in FIG. 31).

By using a packet having a predetermined volume of flavoring constituent and a predetermined minimum volume of gas head space, a gas volume of preferably less than 5 milliliters, a very precise timing of the initial flow of flavoring constituent is achieved at a point early in the dispensing cycle. Moreover, because a minimum head space is employed in the packet a more uniform flow rate of flavoring constituent is achieved throughout the dispensing cycle. This packet design in combination with the mechanically operated platen whose movement during the dispensing cycle is thereby precisely controlled, results in consistently uniform and high quality individual beverage servings. Moreover, the disclosed preferred nozzle design also enhances the uniformity of beverage servings in that it assures a controlled mixing of flavoring constituent and base liquid to thereby minimize foaming and the loss of carbonation from serving to serving.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

What is claimed is:

1. An apparatus for dispensing an individual beverage serving, said beverage including both a flavoring constituent and a base liquid, said dispensing apparatus comprising:

a housing adapted to receive a rupturable packet containing a predetermined amount of said flavoring constituent, said housing having one wall and an opposing movable platen;

electro-mechanically actuated platen driving means for rapidly moving said platen from an open position spaced from said housing wall to a packet rupturing position and thereafter slowly moving said platen from said packet rupturing position to a closed position immediately adjacent said housing wall, said platen driving means including a rotatable cam having a cam surface configured to cause said rapid and slow platen movement thereby rupturing said packet and discharging said flavoring constituent;

a nozzle assembly having a first inlet positioned to receive said flavoring constituent discharged from said packet, a second inlet to receive said base liquid, a mixing zone for mixing said flavoring constituent with said base liquid to make said beverage, and an outlet for discharging said individual serving of said beverage into a serving container; and said platen driving means further including means for stopping the movement of said platen toward said housing wall for a preselected time period immediately after said platen reaches said packet rupturing position.

2. The beverage dispensing apparatus of claim 1 wherein said packet also has a spout defined by said bottom spout seal and having a configuration to discharge said stream of flavoring constituent directly onto said nozzle mixing surface and to prevent discharge of said stream of flavoring constituent directly through said nozzle discharge port.

3. The beverage dispensing system of claim 2 wherein said side seals and said bottom spout seal are stronger than said peel seal but weaker than said top closure seal.

4. The beverage dispensing system of claim 3 wherein said peel seal is rupturable by a peeling force of between about 1.0 and 2.5 lbs. per lineal inch, said side seals and said bottom spout seal are rupturable by a force of between about 2.5 and 3.5 lbs. per lineal inch, and said top closure seal is rupturable by a force of more than about 3.75 lbs. per lineal inch.

5. The beverage dispensing system of claim 4 wherein said packet spout has a proximal end and a distal end, said distal end being displaced laterally from said proximal end so that said stream of flavoring constituent is discharged from said packet at an angle relative to the vertical axis of said packet.

6. The beverage dispensing apparatus of claim 1 wherein said nozzle also has a deflector extending across said mixing zone.

7. The beverage dispensing apparatus of claim 6 wherein said deflector is a bar centrally positioned within said nozzle and has a transverse dimension at least as great as the diameter of said outlet.

8. The beverage dispensing apparatus of claim 7 wherein said diverter bar has a cylindrical configuration.

9. The beverage dispensing apparatus of claim 6 wherein said nozzle assembly includes an outer shell and an insert; said first inlet communicating with the inside of said insert; said second inlet comprising at least one aperture in said shell and communicating with an annular passageway defined by the space between said shell and said insert; and said insert having a radially extending flange about its lower circumference and positioned above said mixing zone.

10. The beverage dispensing apparatus of claim 9 wherein said radially extending flange also includes a plurality of radial fins on its upper surface to distribute said base liquid circumferentially around said nozzle.

11. The beverage dispensing apparatus of claim 1 wherein said cam is configured to stop the movement of said platen for said preselected time period.

12. An apparatus for dispensing an individual beverage serving, said beverage including both a flavoring constituent and a base liquid, said dispensing apparatus comprising:

a housing adapted to receive a rupturable packet containing a predetermined amount of said flavoring constituent, said housing having one wall and an opposing movable platen;

electro-mechanically actuated platen driving means for rapidly moving said platen from an open position spaced from said housing wall to a packet rupturing position and thereafter slowly moving said platen from said packet rupturing position to a closed position immediately adjacent said housing wall, said platen driving means including a rotatable cam having a cam surface configured to cause said rapid and slow platen movement thereby rupturing said packet and discharging said flavoring constituent;

a nozzle assembly having a first inlet positioned to receive said flavoring constituent discharged from said packet, a second inlet to receive said base liquid, a mixing zone for mixing said flavoring constituent with said base liquid to make said beverage, and an outlet for discharging said individual serving of said beverage into a serving container; and said platen driving means further including first biasing means for urging said platen driving means toward said platen, said first biasing means generating a first biasing force greater than that required to rupture said packet.

13. The beverage dispensing apparatus of claim 12 further including second biasing means for urging said platen away from said housing wall, said second biasing means generating a second biasing force less than said first biasing force.

14. The beverage dispensing apparatus of claim 13 wherein said platen driving means act to generate a force that is applied to said platen at a point vertically above that at which said second biasing force is applied, thereby moving the upper end of said platen toward said housing wall before moving the lower end of said platen toward said housing wall during the dispensing cycle.

15. The beverage dispensing apparatus of claim 12 wherein the position of said housing wall is fixed and said first biasing means also acts to urge said platen toward said housing wall.

16. The beverage dispensing apparatus of claim 15 wherein said first biasing means is operatively associated with a platen drive means mounting assembly and permits said platen drive means to move away from said housing wall in the event an obstruction interferes with the movement of said platen toward said housing wall during the dispensing cycle.

17. An apparatus for dispensing an individual beverage serving, said beverage including both a flavoring constituent and a base liquid, said dispensing apparatus comprising:

a housing adapted to receive a rupturable packet containing a predetermined amount of said flavoring constituent, said housing having one wall and an opposing movable platen;

electro-mechanically actuated platen driving means for rapidly moving said platen from an open position spaced from said housing wall to a packet rupturing position and thereafter slowly moving said platen from said packet rupturing position to a closed position immediately adjacent said housing wall, said platen driving means including a rotatable cam having a cam surface configured to cause said rapid and slow platen movement thereby rupturing said packet and discharging said flavoring constituent;

a nozzle assembly having a first inlet positioned to receive said flavoring constituent discharged from said packet, a second inlet to receive said base liquid, a mixing zone for mixing said flavoring constituent with said base liquid to make said beverage, and an outlet for discharging said individual serving of said beverage into a serving container; and said packet containing both a predetermined volume of flavoring constituent and a predetermined volume of gas less than about 10 milliliters, and said platen drive means operating to move said platen in a preselected manner dependent upon said predetermined volumes of flavoring constituent and gas to thereby achieve a substantially homogeneous beverage serving.

18. The beverage dispensing apparatus of claim 17 wherein said packet contains a volume of gas less than about 5 milliliters.

19. The beverage dispensing apparatus of claim 17 wherein said packet contains a volume of gas less than about 1 milliliter.

20. The beverage dispensing apparatus of claim 17 wherein said beverage is a sugar-containing carbonated beverage and wherein said flavoring constituent and base liquid are mixed to achieve a substantially constant Brix level throughout the beverage serving in said serving container.

21. An apparatus for dispensing an individual beverage serving, said beverage including both a flavoring constituent and a base liquid, said dispensing apparatus comprising:

a housing adapted to receive a rupturable packet containing a predetermined amount of said flavoring constituent, said housing having one wall and an opposing movable platen;

electro-mechanically actuated platen driving means for rapidly moving said platen from an open position spaced from said housing wall to a packet rupturing position and thereafter slowly moving said platen from said packet rupturing position to a closed position immediately adjacent said housing wall, said platen driving means including a rotatable cam having a cam surface configured to cause said rapid and slow platen movement thereby rupturing said packet and discharging said flavoring constituent;

a nozzle assembly having a first inlet positioned to receive said flavoring constituent discharged from said packet, a second inlet to receive said base liquid, a mixing zone for mixing said flavoring constituent with said base liquid to make said beverage, and an outlet for discharging said individual serving of said beverage into a serving container; and said platen driving means further including means for moving said platen away from said housing wall a preselected distance immediately after said platen reaches said packet rupturing position but before moving said platen toward said closed position.

22. The beverage dispensing apparatus of claim 21 wherein said cam is configured to move said platen away from said housing wall said preselected distance.

23. A system for dispensing an individual serving of a beverage containing both a liquid flavoring constituent and a base liquid, said system comprising:

a rupturable packet containing a predetermined volume of said flavoring constituent and a predetermined volume of gas;

means for delivering said base liquid to a nozzle;

a packet rupturing mechanism including a wall and a platen adapted to receive and rupture said packet thereby discharging said flavoring constituent into said nozzle; and platen control and drive means for continuously controlling the movement of said platen toward said wall in a preselected manner dependent upon the predetermined volumes of said flavoring constituent and gas within said packet to thereby obtain a predetermined flow rate of said flavoring constituent from said packet and a substantially uniform mixture of said flavoring constituent and said base liquid in said individual beverage serving.

24. A method for dispensing an individual beverage serving which contains both a flavoring constituent and a base liquid, said method comprising:

placing a packet containing a predetermined volume of said flavoring constituent and a predetermined volume of a gas into a packet rupturing mechanism having a movable platen;

moving said platen and continuously controlling the movement of said platen in a preselected manner dependent upon the predetermined volumes of said flavoring constituent and gas within said packet to thereby rupture said packet and discharge said flavoring constituent into a nozzle at a controlled and predetermined flow rate;

delivering said base liquid to said nozzle in a measured amount; and discharging said beverage serving from said nozzle.

* * * * *